United States Patent [19]

Fitzer

[11] 4,227,350

[45] Oct. 14, 1980

[54] LOW-DENSITY ABRASIVE PRODUCT AND METHOD OF MAKING THE SAME

[75] Inventor: Robert C. Fitzer, Birchwood Village, Minn.

[73] Assignee: Minnesota Mining and Manufacturing Company, Saint Paul, Minn.

[21] Appl. No.: 847,922

[22] Filed: Nov. 2, 1977

[51] Int. Cl.[3] ..... B24D 11/02

[52] U.S. Cl. ..... 51/295; 51/294; 51/297; 51/298

[58] Field of Search ..... 51/295, 298, 299, 294, 51/297, 296

[56] References Cited

U.S. PATENT DOCUMENTS

| | | | |
|---|---|---|---|
| 2,740,725 | 4/1956 | Ball | 51/298 |
| 2,810,426 | 10/1957 | Till et al. | 51/296 |
| 2,958,593 | 11/1960 | Hoover et al. | 51/296 |
| 2,970,929 | 2/1961 | Hansen et al. | 51/298 |
| 3,016,294 | 1/1962 | Haywood | 51/298 |
| 3,020,139 | 2/1962 | Camp et al. | 51/298 |
| 3,026,190 | 3/1962 | McMahon et al. | 51/295 |
| 3,169,899 | 2/1965 | Steuber | 51/298 |
| 3,260,582 | 7/1966 | Zimmer et al. | 51/295 |
| 3,537,121 | 11/1970 | McAvoy | 51/295 |
| 3,547,608 | 12/1970 | Kitazawa | 51/294 |
| 3,686,049 | 8/1972 | Manner et al. | 264/168 |
| 3,687,759 | 8/1972 | Stapp | 264/168 |
| 3,691,004 | 9/1972 | Werner et al. | 264/168 |
| 3,837,988 | 9/1974 | Hennen et al. | 51/294 |
| 3,852,152 | 12/1974 | Werner | 264/168 |
| 3,936,337 | 2/1976 | Stapp | 156/157 |
| 4,011,063 | 3/1977 | Johnston | 51/295 |
| 4,018,575 | 4/1977 | Davis et al. | 51/298 |

*Primary Examiner*—Donald J. Arnold
*Attorney, Agent, or Firm*—Cruzan Alexander; Donald M. Sell; Richard Francis

[57] ABSTRACT

A low-density abrasive product formed of a uniform cross-section lofty web comprised of continuous three-dimensionally undulated inter-engaged autogenously bonded filaments of high yield strength filament-forming material impregnated with a tough adherent binder which adherently bonds the filaments together and also bonds a multitude of abrasive granules uniformly dispersed throughout the web. The abrasive article is made by forming the web by an extrusion process, uniformly coating the filaments of the web with a liquid curable binder resin, depositing the abrasive granules onto the web coating, curing the first binder coating, applying a second coating of liquid curable binder and then curing the binder.

19 Claims, 6 Drawing Figures

LOW-DENSITY ABRASIVE PRODUCT AND METHOD OF MAKING THE SAME

BACKGROUND OF THE INVENTION

1. Field of the Invention

This invention relates to a novel low-density abrasive product employing a web of autogenously bonded continuous, undulated, inter-engaged filaments and a method of making the same.

2. Background of the Prior Art

The use of low-density abrasive products, e.g., for scouring surfaces such as the soiled surfaces of pots and pans, and for other purposes is known. These pads are typically non-woven lofty open mats formed from randomly disposed staple fibers which are bonded together at points where they intersect and contact each other with a binder which contains abrasive articles. The staple fibers typically have been crimped and are laid down by equipment such as a "Rando-Webber" web-forming machine to form a lofty open mat. One very successful commercial embodiment of such an abrasive product is that sold under the trade designation "Scotch-Brite" by the 3M Company of St. Paul, Minn. Low-density abrasive products of this type can be prepared by the method disclosed by Hoover et al in U.S. Pat. No. 2,958,593.

While such abrasive products have had excellent commercial success, they require a considerable investment in the equipment required for producing them. A "Rando-Webber" web-forming machine, for example, can cost in the thousands of dollars. Additionally, the fibers going to form the web of such abrasive products typically require chopping to produce staple fibers, crimping to produce the requisite degree of loft in the resultant web and the separate formation of the web. Each of these steps is costly and time consuming.

SUMMARY OF THE PRESENT INVENTION

The present invention provides a low-density abrasive product which comprises a uniform cross-section, generally flat-surfaced, open, porous, lofty web of autogenously bonded continuous, undulated, inter-engaged filaments. The web is impregnated with a tough binder resin which adherently bonds the filaments of the web together and also bonds a multitude of abrasive granules, uniformly dispersed throughout the web, to the surface of the filaments.

The web has at least one layer of filaments and may comprise several layers. Each layer of filaments is comprised of a multitude of three-dimensionally generally irregularly undulated filaments of high yield strength filament-forming material. Adjacent filaments within and between layers, if there is more than one layer, are inter-engaged and autogenously bonded for the most part where they touch one another. The binder resin is initially liquid and can be coated and will cure, under conditions which will not damage the web, to a tough adherent material. The cured binder resin has a tensile strength of at least 3000 psi, an ultimate elongation of at least 180% and a Shore D hardness of at least about 40.

The abrasive article of the invention is made by forming the web by an extrusion method, as will hereinafter be explained, uniformly coating the filaments of the web to provide a wet coating sufficient to initially adhere the abrasive granules uniformly throughout the web, depositing the abrasive granules uniformly throughout the resin-coated web, curing the first coating of binder resin, coating the abrasive-granule coated web with binder resin to provide a cured coating which will adherently bond the granules to the surface of the filaments, and curing the second coating of binder resin.

THE DRAWING

The many advantages and features of the present invention can best be understood and appreciated by reference to the accompanying drawing, wherein.

DETAILED DESCRIPTION OF THE INVENTION

Figure 1:
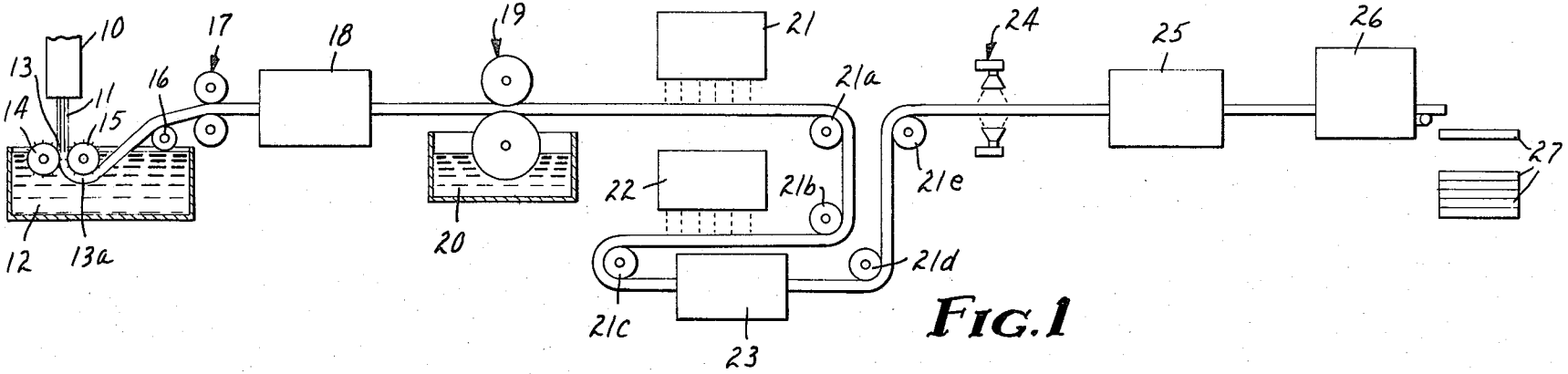
FIG. 1 is a schematic illustration in elevation showing the process and apparatus used in making the abrasive article of the invention.
Figure 2:
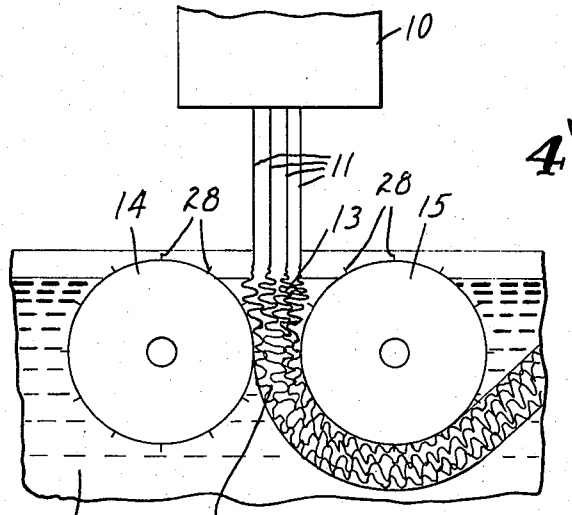
FIG. 2 is an enlarged detailed view of a portion of FIG. 1, illustrating an integral aspect of the process.

As shown in FIGS. 1 and 2, synthetic organic filament-forming material is heated to a molten state and extruded from an extrusion spinneret 10 which contains at least one row of openings to provide a bundle of free-falling filaments 11. Filaments 11 are permitted to freely fall through an air space into a quench bath 12 where they coil and undulate at or near the surface of bath 12 to form an autogenously bonded web 13. While it is still sufficiently plastic to be permanently deformed, web 13 is then passed between opposed smooth-surfaced rollers 14 and 15 which may have a pattern of uniformly spaced spikes 28 projecting from the roller surface which are positioned to provide a substantially flat-surfaced web **13*a*. Web 13*a* is then drawn around one of the rollers, e.g., roller 15, for removal from quench bath 12. Web 13*a* is then passed over idler roll 16 between guide roll set 17, through drying station, e.g., forced air oven 18, to remove residual quench liquid and through roll coating station 19 where the liquid curable resin binder 20 is applied. Any other conventional web coating technique may be employed to coat the web so long as it provides a substantially uniform coating. For example, dip coating and spray coating may also be used. The wet resin coating should be sufficient to permit uniform coating of the web with granules. Thereafter, the wet coated web is passed beneath abrasive granule dropping station 21 to coat one side of the web with abrasive granules and deployed in an S-shaped arrangement around suitable idler rollers 21*a*, 21*b*, 21*c*, 21*d* and 21*e* to reverse the web surfaces (that is, face the bottom side up). The other surface of the web is then passed under second abrasive granule depositing station 22 to provide a web which has been uniformly coated with abrasive granules. Other granule application or coating devices may also be used; e.g., the granules may be applied by a spray method such as employed in sandblasting except with milder conditions, by electrostatic coating methods, and the like. The granule-coated web is then passed through a curing station, e.g., forced air oven 23, to cure the first resin coat and then a second coating of resin is applied with a suitable device such as spray station 24 which simultaneously sprays top and bottom surface of the web with a quantity of binder material which will adherently bond the abrasive granules to the surface of the web and the filaments together. The quantity of the second binder coating should be limited so it will not mask the abrasive particles. Once coated, the web is then passed through second curing station, e.g., forced air oven 25, and into converting station 26 where it is cut into desired shapes 27**.

Figure 3:
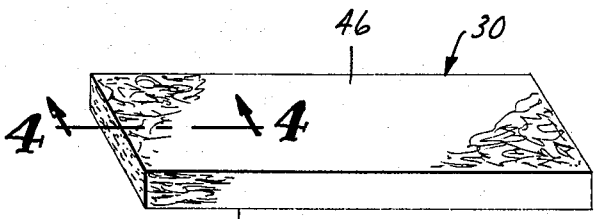
FIG. 3 is an enlarged detailed perspective view illustrating an abrasive article made in accordance with the present invention.
Figure 5:
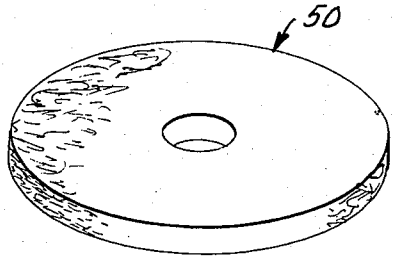
FIG. 5 is another embodiment of an abrasive article made in accord with the present invention.
Figure 6:
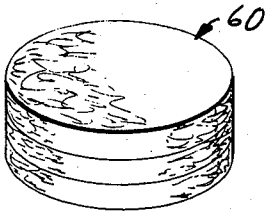
FIG. 6 is yet another embodiment of the abrasive article of the present invention made in accord with the present invention.

Typical shapes of the abrasive article of the invention include those depicted by FIGS. 3, 5 and 6. FIG. 3 shows a rectangular shape abrasive product 30 while FIG. 5 shows an annulus shape abrasive product 50. FIG. 6 shows yet another embodiment which is made by stacking several layers of the web after the second application of resin binder but prior to the second curing step, compressing the stack and and curing to provide a relatively densified abrasive product which may be cut into any of a variety of shapes such as cylinder 60.

One unique aspect of the method of the invention is that the abrasive product can be formed in a continuous process, if desired, virtually directly from the basic ingredients, i.e., from the filament-forming material, liquid curable binder and abrasive granules. That is, the thermoplastic organic filament-forming material can be extruded directly into a lofty, open, porous, filament web without requiring separate fiber chopping operations, crimping, and web-making operations which require equipment such as the "Rando-Webber" web-making device. Binder resin and abrasive granules are then applied to the web to provide the finished abrasive article.

In the web-making process employed in the present invention, thermoplastic organic filament-forming material is inserted into an extruder equipped with a spinneret head which has a multitude of openings equally spaced in at least one row, preferably in a plurality of spaced rows of equally spaced openings. The row or rows of molten filaments are then extruded downwardly, permitted to freely fall a short distance through an air space and then into a quench bath. As the filaments enter the quench bath, they begin to coil and undulate, thereby setting up a degree of resistance to the flow of the molten filaments, causing the molten filaments to oscillate just above the bath surface. The spacing of the extrusion openings from which the filaments are formed is such that, as the molten filaments coil and undulate at the bath surface, adjacent filaments touch one another. The coiling and undulating filaments are still sufficiently tacky as this occurs, and, where the filaments touch, most adhere to one another to cause autogenous bonding to produce a lofty, open, porous handleable filament web.

The web is then directed into the quench bath between opposed rollers positioned a distance below the surface of the quench bath where the filaments of the integrated mat will still be sufficiently plastic to be permanently deformed as they pass therebetween. These rolls are operated at the same speed but in opposite directions to draw the formed filament web away from the area where the filaments have coiled, undulated and autogenously bonded together. The rolls are spaced to contact the surfaces of the web with slight pressure sufficient to smooth any uneven surface loops and undulations to provide a web with generally flat surfaces. The rolls are not so close to alter the uniformity of the web. That is, the roller contact will not provide a higher density of filaments at either surface of the web. Instead, the web will have a uniform cross-section after being passed between the rollers. For this purpose, the surfaces of the rolls are preferably smooth to produce the generally flat surface. Since useful abrasive articles may also have other than flat surfaces, the roll surfaces may have other configurations to provide an abrasive article with a modified surface. For example, a pleated surface roller will produce webs with a pleated surface. Additionally, the roll surface preferably has spikes uniformly disposed on its surface to provide for more secure web handling.

The rolls are operated at a surface speed substantially slower than the extrusion speed to permit sufficient time for the filaments to coil and undulate and form a lofty web with a high degree of undulation in each filament. That is, ratio of the actual filament length to the length of web into which it is incorporated will typically be on the order of 4:1 to 8:1.

Figure 4:
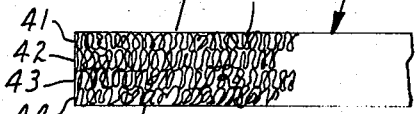
FIG. 4 is a cross-sectional view of the abrasive article depicted in FIG. 3 taken at line 4—4 of FIG. 3.

This process produces a web wherein each filament is coiled and undulated, typically in a regular manner, throughout its length. That is, the ratio of the actual filament length to the length of the web into which it is incorporated will be substantially constant with unchanged process conditions. The undulations of each filament are typically irregular although it is possible to adjust the process to produce regular helically coiled filaments. Irregular filament undulation is characterized by random looping, kinking or bending of the filaments through the web in a pattern defined generally by the pattern of openings of the spinneret. It should be noted that, where more than one row of filaments is extruded, a web is produced having layers of coiled and undulated filaments, each layer representing a row of extruded filaments. Each layer is discernible, sometimes with great difficulty, in the web. The adjacent filaments between layers will also be autogenously bonded together for the most part where they touch one another. This aspect of the web is shown in FIG. 4 of the drawing which shows 4 rows 41, 42, 43 and 44 of undulated filaments 45. Note the outer rows 41 and 45, respectively, have substantially flat surfaces 46 and 47, respectively.

The filament-forming material which is extruded to provide the lofty web contained in the low-density abrasive product of the invention is formed of an organic thermoplastic polymeric material which can be extruded through extrusion orifices to form filaments. The thermoplastic material has a high yield strength of at least 3000 psi to provide the necessary degree of toughness for prolonged use as an abrasive article. A particularly useful polymeric material for forming the filaments of the web of the abrasive product of the invention is polyamide such as polycaprolactam and polyhexamethylene adipamide (e.g., nylon 6 and nylon 6,6). Other useful filament-forming polymeric materials include polyolefins (e.g., polypropylene and polyethylene), polyesters (e.g., polyethylene terephthalate), polycarbonate and the like.

The webs produced by the process described above are particularly suited for abrasive products because they are extremely open, porous, and lofty which permits prolonged usage of the abrasive article for scouring (for example, in areas where large amounts of attrited matter is produced), without filling the web and thus interfering with its abrasive properties. The degree of openness and loftiness is evidenced by the web void volume which is typically at least about 80% (preferably about 85% to about 97%) in the uncoated state. Upon coating with the resin binder, the web also has a considerable degree of structural integrity which permits prolonged usage of the abrasive article.

The flattening effect of the rollers provides a unique abrasive structure which is highly open at the surface yet has a flat face capable of use on flat surfaces without requiring bending or modification of the web. Additionally, the web, even with the resin binder coating and abrasive granules, is extremely flexible and conformable and will typically conform to most surfaces upon which it is used.

The web can be made in a wide variety of thicknesses, limited only by the design of the spinneret through which it is extruded and for economic reasons, of course. Typical web thicknesses useful for abrasive products will vary between ¼ inch and 3 inches.

The filament diameter of the filaments in the web produced by the process described above may be varied by modification of the web-making process. Typically, the filament diameter for a web useful as in the abrasive articles of the invention will be on the order of 5 to 125 mils, but preferably is on the order of 10 to 20 mils. Spinneret extrusion openings of 5 to 125 mils will produce such products. The openings will be in rows, as previously stated, and separated by at least about 0.1 inch to produce satisfactory results. The openings of adjacent rows may be offset from one another although the spinneret performs suitably when the openings in the rows are aligned. It should be noted that one does not necessarily obtain a filament in the quenched web which is identical to the diameter of the extrusion orifice from which it was extruded. There may be some thickening of the molten filament near the extrusion orifice caused by surface tension which would tend to increase the filament diameter. There may also be some decrease of the filament diameter caused by attenuation in the free fall zone between the extrusion orifices and the quench bath surface, the attenuation increasing as the free fall height increases. The free fall height may vary between about 2 and about 20 inches to produce a satisfactory product. Typically the free fall height will be on the order of from 5 to 15 inches.

There are similar processes of making webs of this type by extrusion known in the prior art, but none recognizes the required web configuration to produce a useful non-woven abrasive article. Nor is there any recognition in this prior art of a particular combination of web and resin binder required to produce an acceptable abrasive article. For example, U.S. Pat. Nos. 3,691,004 and 3,852,152 disclose the process of making a web by dropping the extruded filaments onto the surface of the quench bath with no contacting surface, leaving an irregular-surfaced mat. These patents also suggest the use of a contact surface which densifies one or both sides of the mat as it is formed to produce a mat with one side having filaments at a higher density. Incorporating such a mat into an abrasive article would not provide a suitable open porous lofty non-woven abrasive article. Such an article would easily clog with debris due to the surface compaction or densification of the filaments. U.S. Pat. No. 3,936,337 shows a modification of the process of the previously cited patents which calls for densification of both surfaces of the web. U.S. Pat. No. 3,687,759 discloses a process for making a helically coiled filament mat by dropping the filaments directly into the quench bath without contacting the mat surface at all. This process would produce a mat having undesirable (for an abrasive article) surface irregularities. U.S. Pat. Nos. 3,837,988 and 3,686,049 disclose an integrated web made by a process which requires that one surface of the rows of extruded filaments contact a surface above the quench bath liquid, providing for densification of the filaments on that surface. While this web may be extremely useful as a floor covering material, as suggested in the patents, it provides a less useful abrasive article because of the densification of the one surface and because of the irregularity of the opposite surface. While it is suggested in that patent that abrasive can be applied to the surface of the web, there is no suggestion in the patent of any means of adhering the abrasive to the surface of the web.

The preferred binder resin employed in the production of the claimed abrasive products has a liquid state to provide a coatable composition, yet it can be cured to form a tough, adherent material capable of adherently bonding the abrasive granules to the web even under aggressive use conditions. The cured resin binder will have a tensile strength of at least 3000 psi, and an ultimate elongation of at least 180% and a Shore D hardness of at least 40. Materials not meeting these minimum physical property requirements would not provide a product which could be used for prolonged periods.

The presently preferred resin binder material is a polyurethane which may be prepared of certain isocyanate prepolymeric materials such as that sold under the trade designation "Adiprene" L type, for example L-42, L-83, L-100, L-167, L-200, L-213, L-300 and L-315, which may be cured with 4,4'-methylene-bis 2-chloroaniline (which is commercially available under the trade designation "MOCA"). The reactive isocyanate groups of these prepolymeric materials may be blocked with blocking agents such as ketoxime or phenol to give a liquid material which may be cured with 4,4'-methylene-bis aniline*. These materials will cure with heating in the temperature range of 220° F. to 300° F. to produce cured binder resin having the requisite physical properties, yet they are initially liquid and have sufficient pot life to use in the process described herein to produce the claimed abrasive product. The uncured, unblocked prepolymeric materials will have a nominal NCO content of from about 3% to about 10%, a nominal viscosity at 30° C. of about 6000 cps to about 30,000 cps and a specific gravity of about 1.03 to about 1.15 at 25° C. The cured resinous urethane materials typically have a tensile strength from about 3000 psi to about 11,000 psi, an ultimate elongation of about 180% to about 800% and a Shore D hardness value of about 40 to 80.

*Also known under the chemical name p,p'-methylene dianiline

The quantity of resinous binder material will be sufficient to adherently bond the abrasive granules throughout the web to provide a long-life abrasive product yet will be limited so that it will not mask the abrasive particles themselves. Thus, as the size of the abrasive particle varies, some modification may be required in the amount of binder resin used. For example, a smaller abrasive particle may require a thinner binder layer. Besides binding the abrasive granules to the surfaces of the filaments of the web, the resinous binder material also provides for additional bonding of the filaments forming the web itself. While these filaments have been autogenously bonded together during the web forming operation, they are still subject to separation, especially where large mechanical forces are applied to the abrasive article of the invention. The resinous coating applied to bond the abrasive granules also provides adherent bonding between the touching filaments to provide a long-life abrasive product.

Quite surprisingly, it has been found that only the binders having the physical properties described above will provide useful abrasive products. The requirement of these physical properties virtually excludes all but a few adhesive binder resins typically employed as in the production of low-density abrasive products. For example, such typically employed binder resins as the phenolic resins and certain of the epoxy resins will produce an abrasive product which has poor durability evidenced by a very short useful life.

The abrasive granules employed in the practice of the present invention may be any known abrasive material commonly used in the abrasive art. The abrasive particle size may vary from 10 grit to 600 grit (average diameter 0.01 to 2 mm) and the materials forming the abrasive granules may vary in Mohs hardness from 4 to 10. Examples of minerals which provide useful abrasive granules include pumice, topaz, garnet, alumina, corundum, silicon carbide, zirconia and diamond. The abrasive article may also contain mixtures of several particle sizes, different abrasive materials uniformly incorporated therein or different abrasive sizes, hardnesses or materials on either surface. It will be well within the skill of the art, once being apprised of the present invention, to modify the abrasive article according to the particular application by selecting the appropriate abrasive material.

The abrasive articles of the present invention may be modified in other ways without departing from the scope of the claims. For example, commonly known additive materials may be employed in the abrasive-binder coating such as metal working lubricants (e.g., greases, oils, and metal stearates). Such additives are typically added during the second binder coating operation so as not to interfere with adhesion to the filaments.

The abrasive articles of the present invention may be in any of a variety of shapes as typically encountered for non-woven abrasive products. For example, they may be as rectangular pads, disc-shaped pads which may have a central opening for attachment of an arbor for rotation. They may be cut into shapes such as rectangular shapes and mounted about the periphery of a rotatable hub to provide a flap wheel. Other shapes are also contemplated.

The abrasive article of the invention may be laminated to other layers to provide a modified abrasive article. For example, the abrasive article may be laminated to a foam or sponge layer to provide dual cleaning functions or to provide a cushioning layer. Any of a variety of mounting devices or handles may also be applied to the abrasive article to provide a cleaning implement which may have a removable or permanently attached handle.

The abrasive products of the present invention are aggressive cleaning implements which may be utilized in any of a variety of situations. They are much more open than presently available commercial non-woven abrasive products and thus resist loading with swarf or other residual materials produced in use. They can thus be used for much longer periods of time than conventional non-woven abrasive products. It has been discovered, quite unexpectedly, when large abrasive mineral particles are securely bonded to the filaments of the web, there is produced an extremely effective open porous abrasive product which is useful in situations where present commercially available non-woven abrasive products will not perform or will perform poorly. For example, these abrasive products will remove thick, hard, tough coatings of reflective sheeting material from road signs and will remove tempering or heat-treating oxides from metal surfaces. The abrasive products of the invention have an optimum balance of filament strength, resin strength and abrasive mineral adhesion to have an attrition rate such that fresh abrasive mineral particles are constantly being exposed so that the product performs consistently throughout its entire life.

The abrasive products of the invention have been found to perform in a superior manner to conventional non-woven abrasive products in the following situations: removing paint from metal and wood surfaces, removing heat-treating and tempering oxides from wire rod and circular saw blades, removing thick protective grease coatings and oxide coatings from boiler heat exchange tubes prior to welding, removing rust, dirt and contamination from steel coil during reclaiming operations, removing reflective sheeting materials from highway signs during reclaiming operations, removing slag and oxide from the surface of welded parts, and removing the protective paper coating and hard plastic coatings during the reclamation of plastic sheets such as those formed of "Lexan" plastic. These abrasive products also produce decorative finishes on metal parts such as stainless steel tubing and sheeting.

The invention is further illustrated by the following nonlimiting examples, wherein all parts are by weight unless otherwise specified.

EXAMPLE 1

Polycaprolactam polymer (nylon 6, sold by Dow-Badische Corporation as "B-203", having a yield strength of 5800 psi and an ultimate tensile strength of 8900 psi) was extruded at a pressure of 500 psi through a 20 inch long spinneret having 640 openings arranged in four equal rows spaced 0.2 inch apart, each opening having a diameter of 20 mils. The spinneret was heated to about 260° C. and positioned about 9 inches above the surface of a quench bath which was continuously filled and flushed with 60° F. to 70° F. water at the rate of ½ gallon per minute.

Filaments extruded from the spinneret were permitted to fall into the quench bath where they undulated and coiled and between counter rotating opposed 4 inch diameter, 20 inch long smooth-surfaced spiked rolls. Each roll had on its curved surface 0.073 inch diameter, ⅛ inch high cylindrical spikes spaced 1 inch apart positioned in longitudinal rows with 1 inch between rows, with spikes in adjacent rows being offset. Both rolls were positioned in the bath with their axis of rotation 1 inch below the surface of the bath and the rolls were rotated in opposite directions at the rate of 10 feet per minute surface speed. The rolls were adjusted to lightly compress the surfaces of the resultant extruded web, providing a flattened but not densified surface on both sides.

The polymer was extruded at a rate of 180 lbs. per hour, producing filaments from each extrusion orifice at the rate of 60.6 feet per minute, producing a 20 inch wide 0.66 inch thick web having 4 rows of coiled undulated filaments at the rate of 10 feet per minute.

The resultant flat-surfaced web had a uniform thickness and cross-section, was approximately 0.66 inch thick, weighed about 8.7 grains per square inch and had a void volume of about 95%. The filament diameter averaged between 13 and 17 mils in diameter. The web was carried from the quench bath around one of the spiked rolls and excess water was removed from the web by drying with a heated (about 180° F.) air blast.

The dried web was roll coated with a liquid curable resin composition containing the following ingredients:

| Ingredients | Parts |
|---|---|
| Ketoxime-blocked poly-1,4-butylene glycol diisocyanate having a molecular weight of about 1500 (sold under the trade designation "Adiprene" BL-16) | 64.3 |
| Mixture of 35 parts p,p'-methylene dianiline | 22.2 (sufficient to provide one) |
| $NH_2$ group for each NCO group) and 65 parts ethylene glycol monoethyl ether acetate | |
| Glycidoxpropytrimethoxypilane (sold under the trade designation "Silane" Z-6040) | 1.3 |
| Xylene solvent | 10.9 |
| Lampblack pigement | 1.3 |

The ingredients were mixed thoroughly, the xylene employed to adjust the viscosity to that desired for coating and the mixture applied to the web by a roll coating device consisting of an 8 inch diameter rubber roller (50 durometer) which forced the web against a back-up roll and rotated in a pan containing the coating mixture to apply a dry coating weight of 2.5 grains per square inch at a line speed of 2.5 feet per minute.

The coated web was then passed beneath a metered abrasive mineral dropping device which contained 36 grit silicone carbide abrasive granules, making one pass for each side, coating the web uniformly throughout with about 23 grains per square inch of abrasive granule. The web was then passed through a curing oven heated at 290° F. to provide a residence time therein of about 5½ minutes to substantially cure the binder resin. The resultant web was then passed through a coating device consisting of a pair of opposed horizontally oscillating spray guns which applied the following spray composition to the web:

| Ingredients | Parts |
|---|---|
| Ketoxime-blocked poly-1,4-butylene glycol diisocyanate having a molecular weight of about 1500 (sold under the trade designation "Adiprene"BL-16) | 58.6 |
| Mixture of 35 parts p,p'-methylene dianiline (sufficient to provide one $NH_2$ group for each NCO group) and 65 parts ethylene glycol monoethyl ether acetate | 20.2 |
| Glycidoxpropyltrimethoxysilane (sold under the trade designation "Silane" Z6040) | 0.6 |
| Xylene solvent | 19.4 |
| Lampblack pigment | 1.2 |

The coating was then cured as before to provide a dry coating weight of 5.0 grains per square inch and the resultant product was cut into sizes for use.

EXAMPLES 2–12

Examples 2–12 identify additional abrasive products made in accord with the present invention in substantially the same manner as described in Example 1. The type, coating weight and composition of each resin, the type, size and amount of abrasive granules and, the size, type, weight and filament diameter of the web and the resin curing temperature for these examples are all revealed in Table I below. The curing temperature shown in the table is that used for both the first resin coating and the second resin coating. The resin coatings, identified by letters A–E in the table, are defined in the specification after the table.

TABLE I

| | FIRST RESIN | | MINERAL | | | SECOND RESIN | | WEB | | | | PERFORMANCE | |
|---|---|---|---|---|---|---|---|---|---|---|---|---|---|
| Ex. No. | Type | Wt. (gr/in²) | Type | Wt. (gr/in²) | Grit Size | Type | Wt. (gr/in²) | Type | Wt. (gr/in²) | Filament Diameter (mils) | Cure Temp (°F.) | Cut (grams) | % Wt. Loss |
| 2 | A | 2.4 | SiC | 22.1 | 36 | A | 5.3 | Nylon 6 | 8.8 | 14 | 300 | 3.27 | 12.0 |
| 3 | D | 2.4 | SiC | 22.7 | 36 | A | 5.3 | " | 8.4 | 14 | 300 | 3.25 | 9.0 |
| 4 | A | 2.5 | SiC | 25.5 | 36 | D | 5.3 | " | 8.8 | 14 | 300 | 3.21 | 11.6 |
| 5 | D | 2.5 | SiC | 25.5 | 36 | D | 5.3 | " | 8.8 | 14 | 300 | 3.38 | 11.7 |
| 6 | A | 3.0 | SiC | 17.5 | 36 | A | 5.5 | " | 8.3 | 14 | 300 | 3.05 | 13.5 |
| 7 | A | 2.7 | SiC | 28.3 | 36 | A | 5.5 | " | 8.4 | 14 | 300 | 4.98 | 13.1 |
| 8 | A | 2.7 | SiC | 22.1 | 36 | A | 7.8 | " | 8.8 | 14 | 300 | 3.27 | 3.4 |
| 9 | A | 3.3 | SiC | 25.0 | 80 | E | 7.5 | " | 10.8 | 16 | 300 | 5.53 | 4.8 |
| 10 | B | 2.9 | SiC | 27.5 | 36 | B | 6.3 | " | 8.5 | 14 | 300 | 3.95 | 9.8 |
| 11 | C | 3.1 | SiC | 25.0 | 36 | C | 5.8 | " | 9.4 | 14 | 300 | 2.88 | 9.2 |
| 12 | A | 2.5 | $Al_2O_3$ | 30.3 | 60/80 | A | 5.3 | " | 8.5 | 14 | 300 | 4.90 | 8.2 |

Resin Coatings

A. 100 parts ketoxime-poly-1,4-butylene glycol diisocyanate having a molecular weight of about 1500 (sold under the trade designation "Adiprene" BL-16) cured with 34.5 parts of a mixture of 35 parts p,p'-methylene dianiline (sufficient to provide one $NH_2$ group for each NCO group) and 65 parts ethylene glycol monoethyl ether acetate (the mixture hereinafter called "MDA").

B. 100 parts poly-1,4-butylene glycol diisocyanate (sold under the trade designation "Adiprene"L-42) cured with 15.2 parts MDA.

C. 100 parts poly-1,4-butylene glycol diisocyanate (sold under the trade designation "Adiprene" L-100) having all of its reactive isocyanate groups blocked with ketoxime, cured with 19.9 parts MDA.

D. 100 parts "Adiprene" BL-16 and 116 parts "Adiprene" L-315 having all of its reactive isocyanate groups blocked with ketoxime, cured with 85.6 parts MDA.

E. 100 parts poly-4-butylene glycol diisocyanate (sold under the trade designation "Adiprene" L-315) having all of its reactive isocyanate groups blocked with ketoxime, cured with 43.4 parts MDA.

The examples according to the present invention were evaluated for performance by using a wear test for a period of four minutes involving rotating a disc shaped sample of abrasive product against a set of linearly oscillating steel blades. The steel blades were in an array consisting of twenty-one 1¼ inch by 3¼ inch by 0.042 inch steel blades mounted ¼ inch apart with the 1¼ inch edges up and in parallel relationship in a rigid mounting block. The blades were made of hardened steel having a Rockwell C hardness of 45. The abrasive discs evaluated consisted of four 8 inch diameter discs of abrasive product which were compressed between 6 inch diameter flanges to produce a 2 inch cylindrical surface. The compressed disc set was rotated on a rotating shaft at a rate of 1200 rpm with a force of 10 lbs. between it and the steel blades. As the disc was rotated, the blades were oscillated in a linear direction along the array of blades with the array being moved in 12 second cycles 5-9/16 inch lengthwise, so that the ends of all the blades were contacted. Four discs were tested for each evaluation.

In the wear test, the total weight of the blades was measured before and after the test to determine the amount of material cut or removed (reported in the table in grams as "cut") from the blades to give an indication of the relative cutting ability of the abrasive product. The percent weight loss of the abrasive disc was also determined and is reported in the table as such. The preferred abrasive products of the invention will have a cut of at least 2.8 grams for the test identified above. The percent weight loss for a preferred abrasive product according to the invention will be less than 18%.

What is claimed is:

1. A method for making low-density abrasive product, comprising:

(1) extruding high yield strength thermoplastic organic filament-forming material to provide at least one row of equally spaced molten filaments which are permitted to fall through an air space and into a quench bath where they coil and undulate to form a uniform cross-section, open, porous, lofty continuous filament web having at least one layer comprised of a multitude of three-dimensionally undulated filaments having a filament diameter of about 5 to 125 mils with adjacent filaments being inter-engaged and from the most part autogenously bonded where they touch one another;

(2) coating said web to provide a wet coating sufficient to initially adhere abrasive granules throughout the web by a first resin binder having an initial liquid state and being capable of being cured to a strong, tough adherent material having a tensile strength of at least about 3000 psi, an ultimate elongation of at least about 180% and a Shore D hardness value of at least about 40;

(3) depositing a multitude of abrasive granules throughout the resin-coated web;

(4) curing said first binder resin coating;

(5) coating the abrasive granule coated web with a coating of a second binder resin having an initial liquid state and being capable of being cured to a strong, tough, adherent material having a tensile strength of at least about 3000 psi, an ultimate elongation of at least 180% and a Shore D hardness value of at least about 40 to provide the coating, which when cured, will expose the abrasive granules on the surface of the filaments, yet, together with said first binder resin, will firmly adherently bond the abrasive granules to the filaments and the filaments to each other to provide a long-life abrasive product; and (6) curing said second binder resin.

2. The method of claim 1 wherein said filament web has at least three layers.

3. The method of claim 1 wherein said first binder resin is applied by roll coating.

4. The method of claim 1 wherein said second binder resin is applied by spray coating.

5. The method of claim 1 wherein said granule coated web is cut into discs after application of said second resn coating but before curing, said discs are stacked and compressed to form a cylindrical configuration and then said second resin coatng is cured.

6. The method of claim 1 wherein said high yield strength filament-forming organic thermoplastic material is polycaprolactam.

7. The method of claim 1 wherein said first binder resin and said second binder resin are polyurethane.

8. The method of claim 7 wherein said polyurethane is formed by the reaction product of ketoxime-blocked poly-1,4-butylene glycol diisocyanate and p,p'-methylene dianiline.

9. A low-density abrasive product comprising a uniform cross-section, open, porous, lofty web having at least one layer, each layer being comprised of a multitude of continuous three-dimensionally undulated fialments of high yield strength filament-forming organic thermoplastic material with adjacent filaments being inter-engaged and autogenously bonded where they touch one another, said filaments having a diameter of about 5 to 125 mils, and a multitude of abrasive granules uniformly dispersed throughout and adherently bonded to the filaments of said web by a tough adherent binder having a tensile strength of at least 3000 psi, an ultimate elongation of at least about 180% and a Shore D hardness of at least about 40.

10. The low-density abrasive product of claim 9 wherein said web has at least three layers.

11. The low-density abrasive product of claim 9 wherein said filaments have a diameter in the range of about 5 to about 125 mils.

12. The low-density abrasive product of claim 11 wherein said filaments have a diameter of about 10 to 20 mils.

13. The low-density abrasive product of claim 9 wherein said web has a thickness on the order of ¼ to about 3 inches.

14. The low-density abrasive product of claim 9 wherein said binder resin is polyurethane.

15. The low-density abrasive product of claim 14 wherein said polyurethane is formed by the reaction product of ketoxime-blocked poly-1,4-butylene glycol diisocyanate and p,p'-methylene dianiline.

16. The low-density abrasive product of claim 9 wherein said high yield strength filament-forming material is polycaprolactam.

17. The low-density abrasive product of claim 9 wherein said web has a void volume, before application of said resin binder and said abrasive granules, of at least about 80%.

18. The low-density abrasive product of claim 17 wherein said void volume is between 80% and 97%.

19. A cylinder shaped low-density abrasive product comprising a plurality of disc shapes of the low-density abrasive product described in claim 9 adherently bonded together.

* * * * *